United States Patent [19]

Tani

[11] Patent Number: 4,725,329

[45] Date of Patent: Feb. 16, 1988

[54] APPARATUS FOR MANUFACTURING EASY-TO OPEN SYNTHETIC RESIN BAG

[75] Inventor: Kanari Tani, Onojo, Japan

[73] Assignee: Kazuhiro Itoh

[21] Appl. No.: 7,074

[22] Filed: Jan. 23, 1987

Related U.S. Application Data

[62] Division of Ser. No. 815,282, Dec. 26, 1985, Pat. No. 4,650,079.

[51] Int. Cl.[4] ..... B32B 31/18

[52] U.S. Cl. ..... 156/436; 156/176; 156/179; 156/250; 156/510; 156/513; 156/514; 53/133; 53/412; 206/616; 493/930

[58] Field of Search ..... 156/176, 179, 250, 436, 156/510, 513, 514; 53/133, 412; 206/605, 607, 616, 620, 631, 633; 493/930

[56] References Cited

U.S. PATENT DOCUMENTS

| | | | |
|---|---|---|---|
| 3,266,965 | 8/1966 | Spees | 493/930 |
| 3,283,672 | 11/1966 | Mueller | 156/176 |
| 3,499,260 | 3/1970 | Forman | 53/133 |
| 4,629,071 | 12/1986 | Tani | 206/616 |

*Primary Examiner*—Caleb Weston

*Attorney, Agent, or Firm*—Jordan and Hamburg

[57] ABSTRACT

An apparatus for manufacturing easy-to-open bags comprising a pair of feed rollers, at least one puncher disposed downstream of said feed rollers, upper and lower separating rollers disposed downstream of said puncher, tear string positioning member disposed downstream of said separating rollers, heat bonding means disposed downstream of tear string positioning means, bag making means disposed downstream of said heat bonding means and cutting means disposed downstream of said bag making means.

1 Claim, 20 Drawing Figures

APPARATUS FOR MANUFACTURING EASY-TO OPEN SYNTHETIC RESIN BAG

This is a division of application Ser. No. 815,282, filed Dec. 26, 1985, now U.S. Pat. No. 4,650,079.

BACKGROUND OF INVENTION

In a conventional bag having a bag body constituted by placing two laminated films formed by laminating together several layers of synthetic resin film over each other and heat-sealing the peripheral edges thereof, when part of the bag body is opened in order to remove the contents, since the bag body is constituted by laminated films, the bag body is difficult to tear and hence the opening is difficult.

For resolving the above defects of the conventional bags, the inventor of the present invention has devised an easy-to-open synthetic resin bag comprising: a bag body constituted by a laminated film formed by laminating synthetic resin films; a tear string bonded to part of the inner surface of the bag body corresponding to the tear line thereof; and a tab formed over an end of the tear string which substantially consists of a pair of parallelly-spaced-apart side notches formed on both sides of the tear string and a transverse groove which is disposed adjacent to the side notches with a suitable space and extends perpendicular to the tear string and has a width far greater than the space between the side notches, whereby pulling the tear string by the tab enables the side surface to which the tear string is bonded to be easily and surely torn, thereby allowing the bag body to be easily and speedily opened.

It is an object of the present invention to provide a bag-manufacturing apparatus capable of continuously and readily manufacturing the above easy-to-open synthetic resin bags in an inexpensive manner.

DETAILED DESCRIPTION OF THE PREFERRED EMBODIMENT

Figure 1:
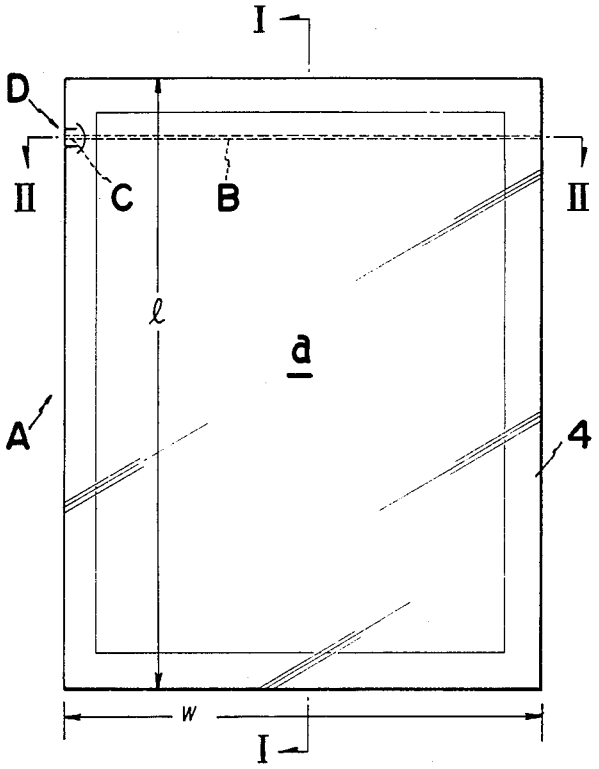
FIG. 1 is a front elevation of an easy-to-open synthetic resin bag manufactured by the apparatus of the present invention.
Figure 2:
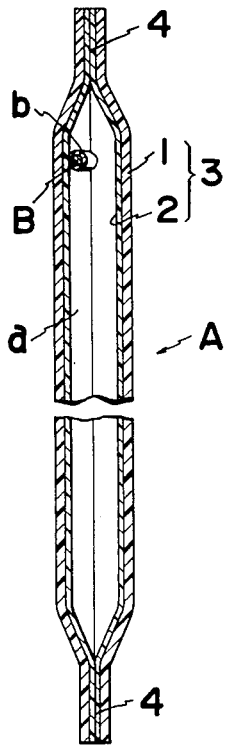
FIG. 2 is a section taken along the line I—I of FIG. 1.
Figure 3:
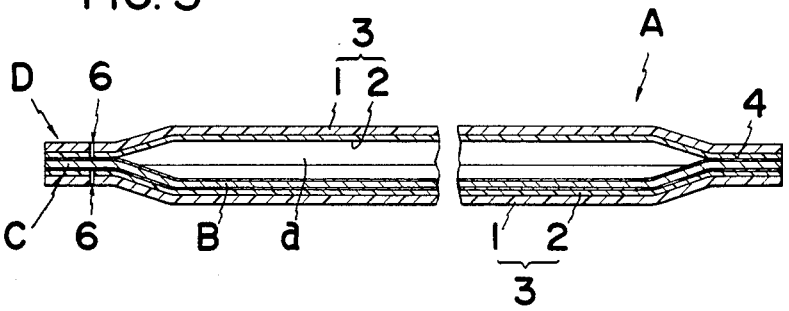
FIG. 3 is a section taken along the line II—II of FIG. 1.
Figure 4:
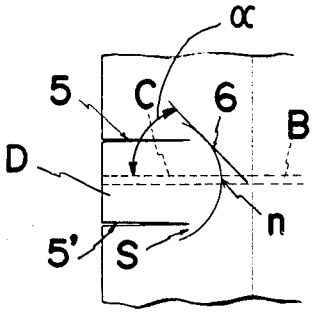
FIG. 4 illustrates a transverse groove formed in a tab part of the bag body of the easy-to-open synthetic resin bag of FIG. 1.
Figure 7:
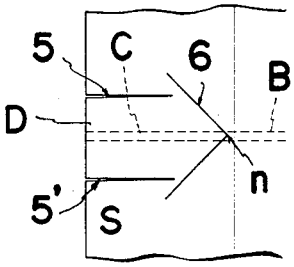
FIGS. 5 through 9 illustrate other examples of the transverse groove shown in FIG. 4.
Figure 5:
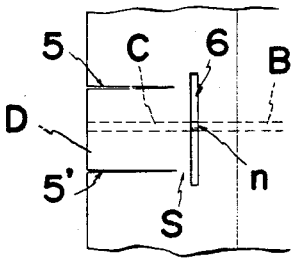
Figure 8:
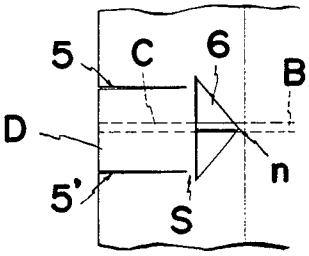
Figure 6:
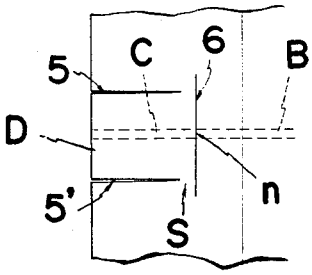
Figure 9:
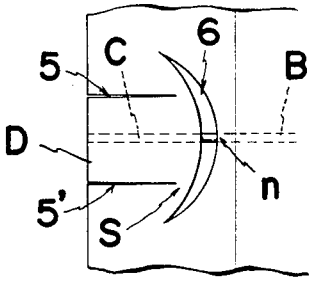
Figure 10:
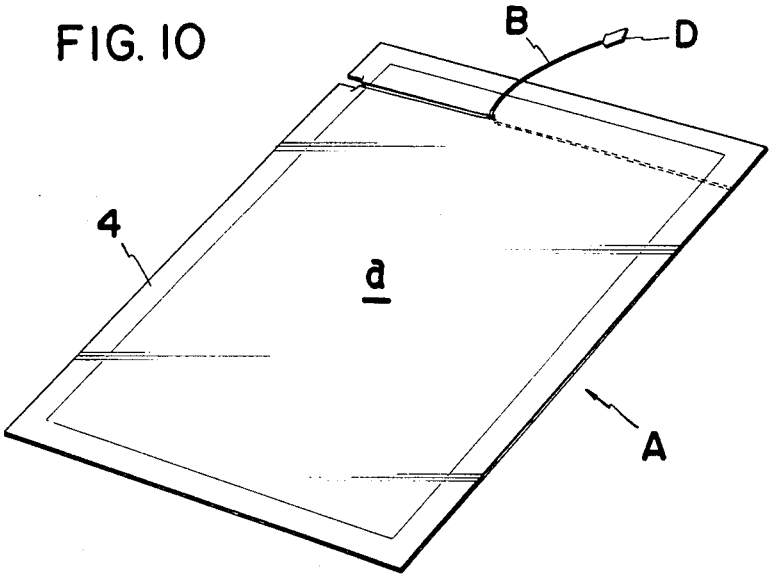
FIG. 10 is a perspective view of the easy-to-open synthetic resin bag of FIG. 1 in which the tear string thereof is being pulled.
Figure 11:
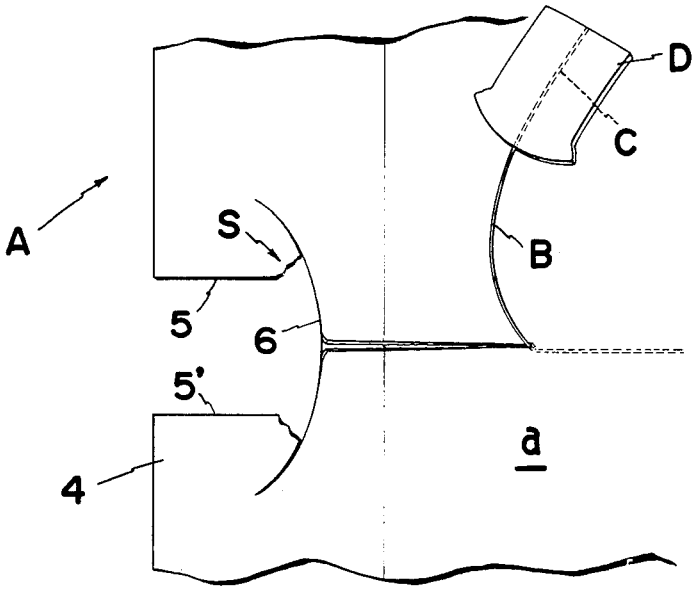
FIG. 11 illustrates the tab.

The construction of an easy-to-open bag manufactured by the apparatus of the present invention is first explained. As shown in FIGS. 1 and 2, a rectangular synthetic resin bag body A having the length of l and the width of w is constituted by a laminated film formed by laminating together the required number of layers of synthetic resin film. A base film 1 comprising one or more layers has heat-sealable plastic film layer 2 laminated on the inner surface thereof. Two laminated films 3 each constituted by laminating together the base film 1 and the heat-sealable plastic film layer 2 are placed with the heat-sealable plastic film layers 2 facing each other, and the peripheral edges of the laminated films 3 are subjected to ultrasonic or heat sealing to constitute the bag body A.

Reference numeral 4 denotes the heat-sealed edges.

A synthetic resin material having such properties as moisture resistance, heat resistance and an ultraviolet-screening property is employed as the base film 1. For the heat-sealable plastic film layer 2, it is possible to employ any material which enables the welding of the heat-sealable plastic film layers 2 to each other when the peripheral edges of the bag body A are subjected to ultrasonic or heat sealing.

The position of the tear opening of synthetic resin bag body A constituted by the laminated film with the arrangement as described above has a tear string B bonded to one inner surface of the bag body A, i.e. one of the heat-sealable plastic film layers 2, as shown in FIG. 2.

It is possible to employ any kind of synthetic resin thread, natural thread or metal wire thread for the tear string B, and it can be either a single thread or a twisted yarn.

In order to bond the tear string B of this kind to the inner surface of the heat-sealable plastic film layer 2, such methods as follows can be used: The outer surface of the tear string B is formed of a heat-sealable resin, thereby enabling the heat-bonding thereof; the tear string B is formed of a twisted yarn consisting of heat-sealable fibers, thereby enabling the heat-bonding thereof; or the surface of the tear string B is coated with a heat-sealable resin b as shown in FIG. 2, thereby enabling the simple bonding of the string to the heat-sealable plastic film layer 2 on heating.

Figure 12:
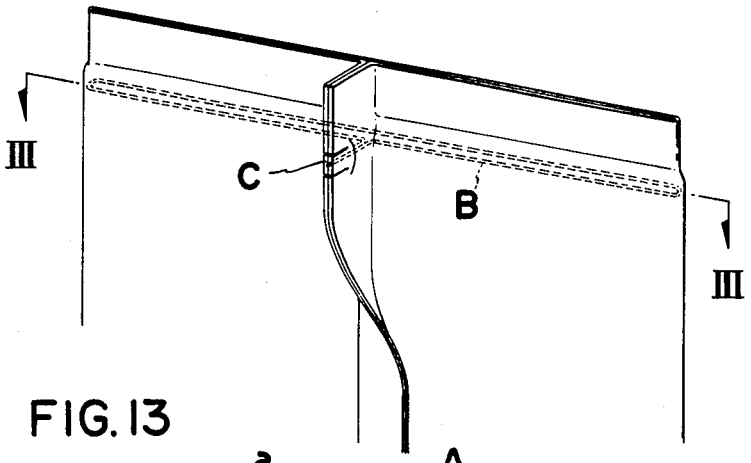
FIG. 12 is a perspective view of another bag body of an easy-to-open synthetic resin bag manufactured by the apparatus of the present invention.
Figure 13:
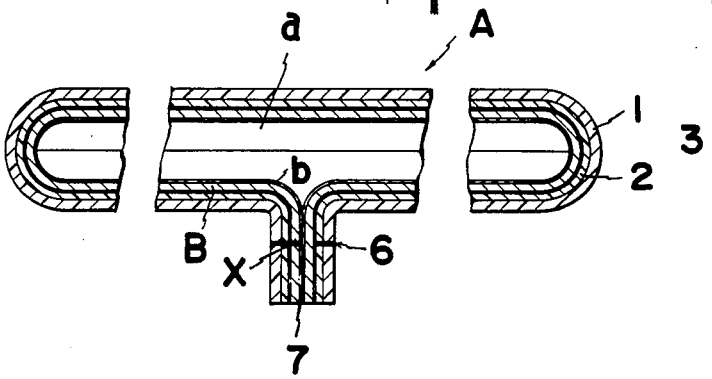
FIG. 13 is an enlarged section taken along the line III—III of FIG. 12.

It must be noted that besides the embodiment wherein the tear string B is bonded to one side wall of the bag body A, the tear string B can be bonded all around the side walls as shown in FIGS. 12 and 13. The end C of the tear string B is clamped between the peripheral edges of the laminated films 3 placed over each other. The end C of the tear string B is provided with a tab D, which has the following structure.

Side notches 5, 5' are formed on both sides of the end C in the pulling direction thereof. A transverse groove 6 is formed crossing the tear string B, with a certain space S provided between the transverse groove 6 and the ends of the notches 5, 5', so that the tab D is formed by the side notches 5, 5' and the transverse groove 6.

The space S provided between the ends of the notches 5, 5' and the transverse groove 6 is to allow the tab D between the side notches 5, 5' to be supported by the heat-sealed edge 4 at the peripheral edge of the bag body A, and the ends of the transverse groove 6 are positioned so as to be at least outside the ends of the corresponding side notches 5, 5'. Thereby, if the tear lines deviate during the process of tearing through the spaces S from the ends of the side notches 5, 5', the tear lines will inevitably reach the transverse groove 6.

A variety of shapes are available for the shape of the transverse groove 6 as shown in FIGS. 4 through 9.

It is desirable that the angle $\alpha$ between the transverse groove 6 and the tear string B toward the interior a of the bag body A should be less than 90°. If the angle is greater than or equal to 90°, the force applied when tearing cannot be concentrated on the area n which is the intersection between the tear string B and the transverse groove 6, so that it becomes difficult for the tear string B to tear through the laminated film 3 smoothly.

The bag body A shown in FIG. 12 is formed in such a way that the edges of a flat laminated film 3 are first laid over each other, the doubled edge is subjected to heat sealing in order to form the laminated film 3 into a tubular shape, and then the upper and lower ends thereof are sealed to obtain a hermetically sealed bag. Side notches 5, 5' and a transverse groove 6 which are similar to those shown in the first embodiment are formed in the edge of the overlapped seal 7, and the tab D is formed over the end C of the tear string B.

The side notches 5, 5' and the transverse groove 6 are formed at both edges of the flat laminated film 3 before forming the overlapped seal 7, and the ends of the laminated film 3 are laid over each other to form the overlapped seal 7. In this case, each of the side notches 5, 5' and the transverse groove 6 is formed, not as a vertical notch-like groove along a line, but as a notch-like groove with a rather larger width, thereby absorbing any slight offset in the positions when the right and left edges are laid over each other, and thus allowing the notches in the right and left edges to align with each other.

Figure 14:
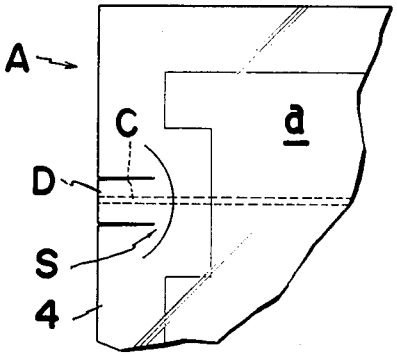
FIG. 14 illustrates another example of the tab.

It must be noted that when the width of the heat-sealed edge 4 is narrow, the part of the heat-sealed edge 4 around the transverse groove 6 is formed so as to have a wider width as shown in FIG. 14.

Figure 15:
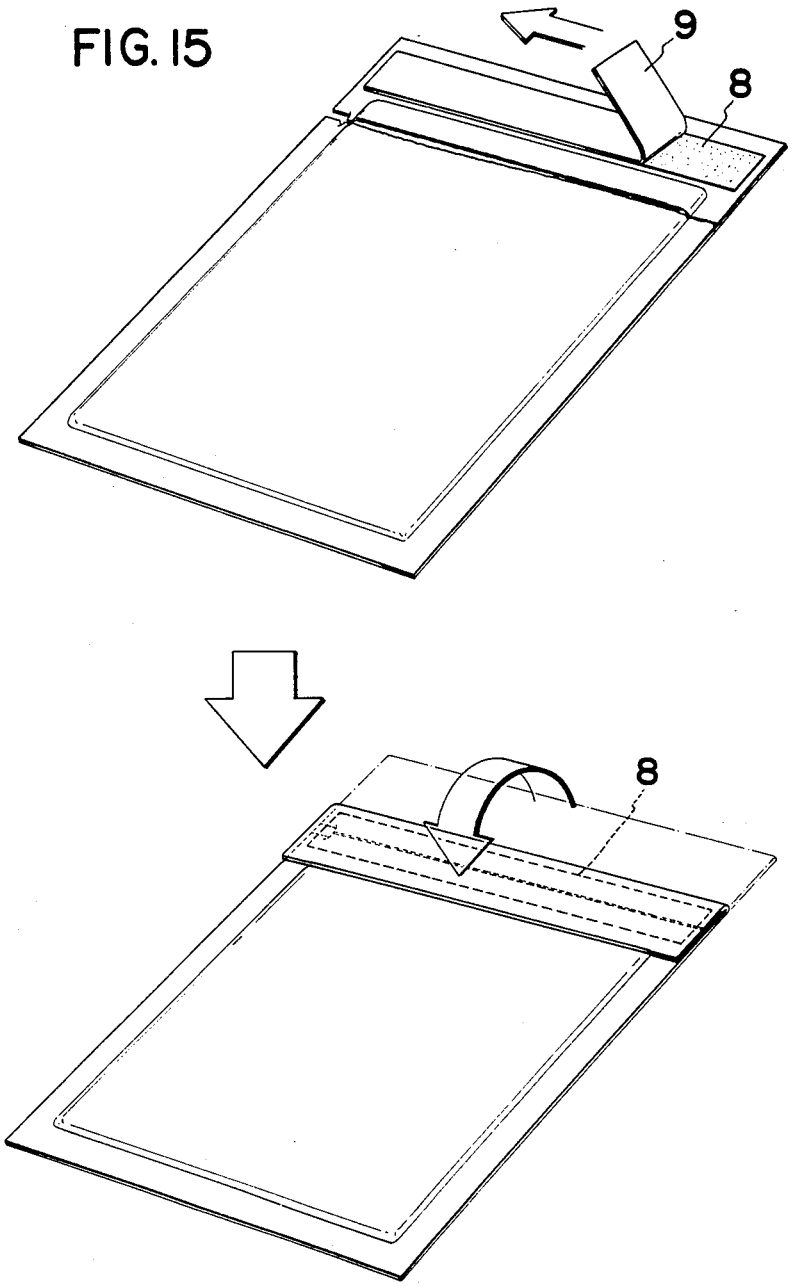
FIG. 15 illustrates still another easy-to-open synthetic resin bag manufactured by the method of the present invention in which a layer of bonding agent is provided on the bag body.

FIG. 15 shows a bonding agent 8 applied to the part of the bag body A above the opening thereof, with a peel-off strip 9 removably attached to the bonding agent 8, which are used for closing the opening by bending over the upper part of the bag body A after it has been opened by pulling the tear string B.

An apparatus of the present invention for manufacturing the above easy-to-open synthetic resin bags shown in FIG. 1 will be described below.

This bag-manufacturing apparatus is constructed as shown in FIGS. 16 through 20.

Figure 16:
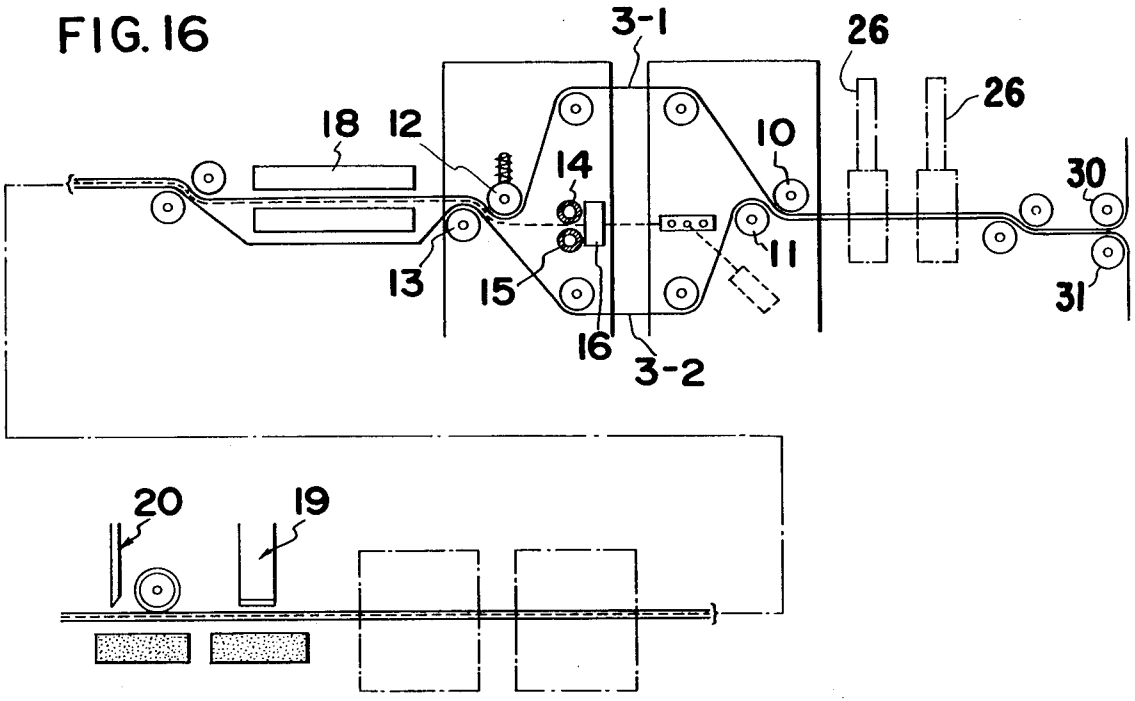
FIG. 16 illustrates the apparatus of the present invention for manufacturing the easy-to-open synthetic resin bag.

In FIG. 16, a pair of feed rollers 30, 31 are provided at one end of the apparatus for feeding a pair of superposed upper and lower laminated films 3-1, 3-2 each of which has a width W several times greater than the length l of the synthetic resin bag body A.

At the downstream side of the feed rollers 30, 31, upper and lower separating rollers 10, 11 are provided facing each other so as to separate vertically an upper continuous laminated film 3-1 which will be the upper surface of the bag body. A from a lower continuous laminated film 3-2 which will be the lower surface of the bag body A.

On the downstream side of the separating rollers 10,11 as viewed in the direction of flow of the films, rollers 12,13 are provided which again superimpose the upper and lower laminated films 3-1,3-2 which were vertically separated from each other defining a tear string inserting space therebetween, and two pipes 14, 15 can be horizontally displaced in the tear string inserting space between the vertically separated laminated films 3-1, 3-2.

Tear string-positioning members 16 are slidably attached to the pipes 14, 15. The tear string-positioning members 16 each have a hole 17 for receiving tear strings B-1 pulled from the side.

The tear strings B-1 passing through the receiving holes 17 are positioned by the lateral sliding of the tear string-positioning members 16, thereby allowing tear strings B-1 to be sandwiched between the upper and lower laminated films 3-1, 3-2.

The upper and lower laminated films 3-1, 3-2 are superimposed, sandwiching between them the tear strings B-1, by means of the rollers 12, 13, are separated vertically again, and then the tear strings B-1 and the upper laminated film 3-1 are bonded together by means of a heat-bonding means 18 in a direction parallel to the film feeding direction as well as a direction perpendicular to the film feeding direction so as to form the heat-sealed edges of a check pattern, wherein each check component is of the size of the easy-to-open synthetic resin bag body A of length l and width of w.

On the downstream side of the heat-bonding means 18, a bag making means 19 and a cutting means 20 are provided for heat-sealing and cutting the bag edges along the above-mentioned heat-sealed edges having the check patterns, thereby manufacturing the easy-to-open synthetic resin bags.

Figure 17:
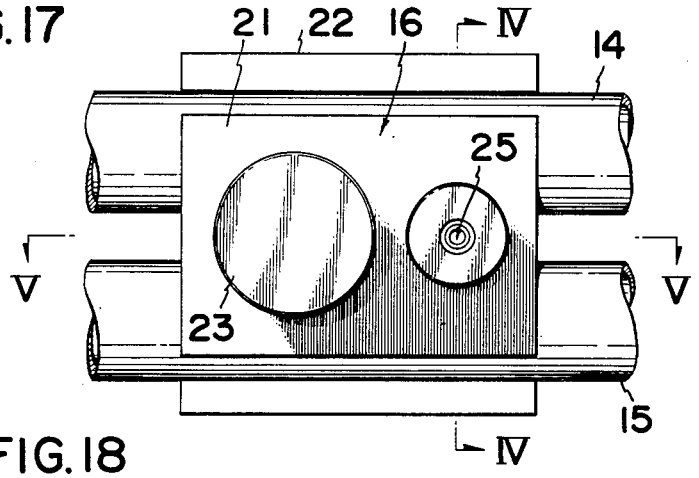
FIG. 17 is a front elevation of a tear string-positioning member of the apparatus shown in FIG. 16.
Figure 18:
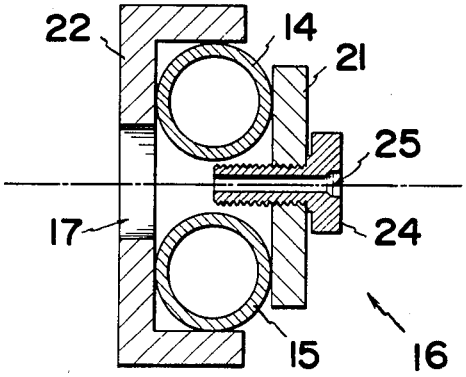
FIG. 18 is a section taken along the line IV—IV of FIG. 17.
Figure 19:
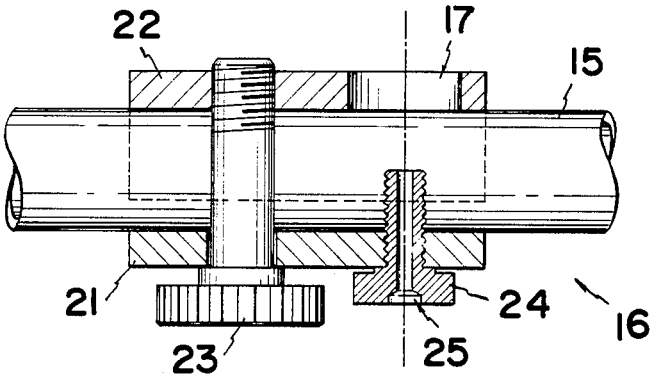
FIG. 19 is a section taken along the line V—V of FIG. 17.
Figure 20:
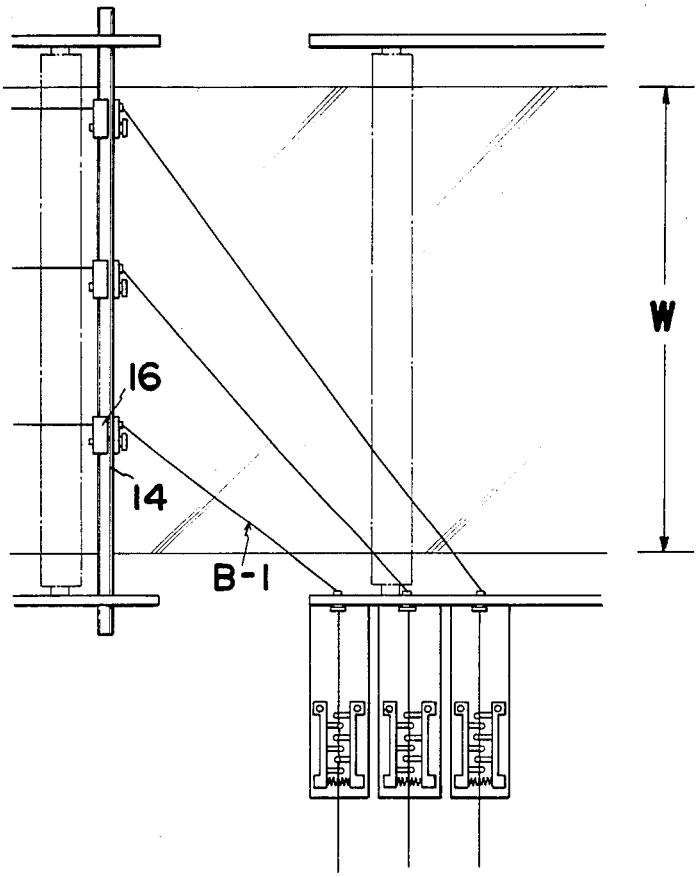
FIG. 20 is a plan view of the tear string inserting mechanism of the apparatus shown in FIG. 16.

The tear string-positioning members 16 will be described below in greater detail. As shown in FIGS. 17 through 19, the two pipes 14, 15 are arranged so as to be clamped by a front plate 21 and a rear plate 22 and fastened by means of a fixing bolt 23. A bolt 24 with an axial hole 25 is screwed into the front plate 21 so as to pass between the pipes 14, 15.

A tear string B-1 is inserted through the hole 25 of the bolt 24, passed between the pipes 14, 15 and led from a receiving hole 17 formed in the rear plate 22.

A puncher 26, which is provided on the upstream side of the separating rollers 10, 11, has the function of applying the transverse grooves 6 to the previously overlapped laminated films 3-1, 3-2 in order to form the tab D.

The side notches 5, 5' constituting the tab D are formed by the cutting means 20 simultaneously with the cutting of the continuous bag body A.

As has been described above, according to the present invention, since the continuous laminated films 3-1, 3-2 are vertically separated by means of the separating rollers 10, 11, respectively, and the tear string B is led into the space therebetween from the tear string-positioning member 16 and is sandwiched between the upper and lower laminated films 3-1, 3-2 and then bonded to the upper laminated film 3-1 by means of the heat-bonding means 18, easy-to-open synthetic resin bag bodies A can be manufactured readily and continuously so that the easy-to-open synthetic resin bags can be manufactured in an extremely inexpensive manner.

What is claimed is:

1. Apparatus for manufacturing easy-to-open bags comprising (a) a pair of feed rollers 30, 31 for feeding a pair of superposed upper and lower laminated films 3-1 and 3-2, each of which has a width W several times greater than the length l of a synthetic resin bag body A of length l and width w, (b) at least one puncher 26 disposed downstream of said feed rollers 30, 31 for forming a transverse groove 6 on said laminated films 3-1 and 3-2 at a location which corresponds to at least one end of a tear opening of each said synthetic resin bag body A, said transverse groove 6 extending in a direction perpendicular to a feeding direction of said laminated films 3-1 and 3-2, (c) upper and lower separating rollers 10, 11 disposed downstream of said puncher 26 for separating said laminated films 3-1 and 3-2 in an upward and downward direction respectively forming a tear string inserting space between said laminated films 3-1 and 3-2, (d) tear string positioning member 16 disposed downstream of said separating rollers 10, 11 and in said tear string inserting space, said tear string positioning member 16 positioning a plurality of tear strings B-1 on the inner surface of said laminated film 3-1 along said tear openings of said respective synthetic resin bag bodies A, (e) heat bonding means 18 disposed downstream of said tear string positioning member 16 for bonding said tear strings B-1 on said inner surface of said laminated film 3-1, (f) bag making means 19 disposed downstream of said heat bonding means 18, said bag making means 19 heat-sealing said laminated films 3-1 and 3-2 together in a direction perpendicular to said feeding direction at intervals which correspond to said width w of said synthetic resin bags A and simultaneously heat-sealing said laminated films 3-1 and 3-2 together in a direction parallel to said feeding direction at intervals which correspond to said length l of said synthetic resin bags A, thereby providing heat-sealed edges 4 of check pattern, and (g) cutting means 20 disposed downstream of said bag making means 19, said cutting means 20 cutting a pair of parallel-extending side notches 5, 5 on said laminated film 3-1 in a direction parallel to said feeding direction at a location laterally spaced by a space S from said transverse groove 6, said cutting means also cutting said laminated films 3-1 and 3-2 along said heat-sealed edges 4 so as to manufacture a plurality of easy-to-open synthetic bag bodies A.

* * * * *